US009718070B2

(12) United States Patent
Arminak et al.

(10) Patent No.: US 9,718,070 B2
(45) Date of Patent: Aug. 1, 2017

(54) INVERTED SQUEEZE FOAMER

(71) Applicant: Arminak & Associates, LLC, Azusa, CA (US)

(72) Inventors: Armin Arminak, Pasadena, CA (US); Gary M. Baughman, Fremont, IN (US); Yen Kean Lee, Riverside, CA (US)

(73) Assignee: Arminak & Associates, LLC, Irwindale, CA (US)

( * ) Notice: Subject to any disclaimer, the term of this patent is extended or adjusted under 35 U.S.C. 154(b) by 5 days.

(21) Appl. No.: 14/036,403

(22) Filed: Sep. 25, 2013

(65) Prior Publication Data

US 2014/0061247 A1 Mar. 6, 2014

Related U.S. Application Data

(63) Continuation of application No. PCT/US2013/054889, filed on Aug. 14, 2013.
(Continued)

(51) Int. Cl.
*B67D 7/76* (2010.01)
*B05B 7/00* (2006.01)
(Continued)

(52) U.S. Cl.
CPC ..... *B05B 7/005* (2013.01); *A47K 5/14* (2013.01); *B05B 7/0037* (2013.01);
(Continued)

(58) Field of Classification Search
CPC ..... B05B 7/005; B05B 7/0062; B05B 7/0037
(Continued)

(56) References Cited

U.S. PATENT DOCUMENTS 3,176,883 A * 4/1965 Davis, Jr. ..... A61M 11/00 222/211
3,622,049 A 11/1971 Thompson
(Continued)

FOREIGN PATENT DOCUMENTS

CN 1407916 A 4/2003
CN 101596509 A 12/2009
(Continued)

OTHER PUBLICATIONS

International Search Report and Written Opinion issued in PCT/US2013/054889, dated Dec. 19, 2013.

*Primary Examiner* — Patrick M Buechner
*Assistant Examiner* — Michael J Melaragno
(74) *Attorney, Agent, or Firm* — Woodard Emhardt Moriarty McNett & Henry LLP

(57) ABSTRACT

A foamer for use in dispensing a liquid product with a foam consistency includes a top cap, a closure, a housing, an air-flow diaphragm, a mesh screen and a valve structure. The closure includes a portion which is received by the cap and these two (2) cooperate to define a foam outlet. The housing is assembled into the closure and the diaphragm is assembled into the housing. The mesh insert is positioned adjacent the foam outlet. The valve structure is provided in two (2) embodiments, one being a duckbill valve with a corresponding holder and the other being a metering valve with a corresponding holder.

23 Claims, 15 Drawing Sheets

Related U.S. Application Data

(60) Provisional application No. 61/695,525, filed on Aug. 31, 2012.

(51) Int. Cl.
*A47K 5/14* (2006.01)
*B05B 11/00* (2006.01)
*B05B 11/04* (2006.01)

(52) U.S. Cl.
CPC ..... *B05B 11/007* (2013.01); *B05B 11/0032* (2013.01); *B05B 11/0072* (2013.01); *B05B 11/04* (2013.01); *Y10T 29/49904* (2015.01)

(58) Field of Classification Search
USPC ..... 222/145.5, 190, 211, 212
See application file for complete search history.

(56) References Cited

U.S. PATENT DOCUMENTS 3,709,437 A 1/1973 Wright
3,937,364 A 2/1976 Wright
3,985,271 A 10/1976 Gardner
4,118,152 A 10/1978 Bron
4,147,306 A * 4/1979 Bennett ..... B05B 11/043 222/212
4,184,615 A 1/1980 Wright
4,274,594 A 6/1981 Ito
4,360,130 A 11/1982 Nishimura
4,364,718 A 12/1982 Beun
4,396,152 A 8/1983 Abplanalp
4,589,573 A 5/1986 Tada
4,673,109 A 6/1987 Cassia
4,730,751 A 3/1988 Mackles et al.
4,880,161 A 11/1989 Wright
5,037,006 A 8/1991 Kock
5,165,577 A 11/1992 Ophardt
5,186,364 A 2/1993 Laszlo
5,219,102 A 6/1993 Wright
5,271,530 A 12/1993 Uehira
5,282,552 A 2/1994 Ophardt
5,337,929 A 8/1994 van der Heijden
5,373,970 A 12/1994 Ophardt
5,431,309 A 7/1995 Ophardt
5,443,569 A 8/1995 Uehira
5,445,288 A 8/1995 Banks
5,467,898 A 11/1995 Hori
5,489,044 A 2/1996 Ophardt
5,518,147 A * 5/1996 Peterson ..... B05B 11/3035 222/153.07
5,570,819 A 11/1996 Uehira
5,664,703 A * 9/1997 Reifenberger ..... B05B 11/0016 222/207
5,676,277 A 10/1997 Ophardt
5,975,360 A 11/1999 Ophardt
6,082,586 A 7/2000 Banks
6,343,724 B1 2/2002 Ophardt
6,394,315 B1 5/2002 Banks
6,398,133 B1 6/2002 Schultz
6,402,054 B1 6/2002 Prueter
6,409,050 B1 6/2002 Ophardt
6,516,976 B2 2/2003 Lewis
6,533,145 B2 3/2003 Lewis
6,536,685 B2 3/2003 Bennett
6,540,117 B2 4/2003 Powling
6,540,157 B2 4/2003 Ophardt
6,543,651 B2 4/2003 Lewis
6,575,334 B2 6/2003 Lewis
6,575,335 B2 6/2003 Lewis
6,601,736 B2 8/2003 Ophardt
6,604,693 B2 8/2003 Santagiuliana
6,868,990 B2 3/2005 Cater et al.
6,951,295 B1 10/2005 Gaus et al.
7,464,839 B2 12/2008 Heukamp
8,020,732 B2 9/2011 van der Heijden
8,042,710 B2 10/2011 van der Heijden
8,056,769 B2 11/2011 van der Heijden
8,187,339 B2 5/2012 Velazquez et al.
8,430,107 B2 * 4/2013 Huang ..... B05B 7/0037 132/112
9,220,377 B2 * 12/2015 Fitzpatrick ..... A47K 5/16
2002/0153389 A1 10/2002 Creaghan et al.
2008/0314931 A1 12/2008 van der Heijden
2010/0126523 A1 * 5/2010 Fujinuma ..... B05B 11/048 132/221
2010/0193547 A1 * 8/2010 Laidler et al. ..... 222/190
2012/0074171 A1 3/2012 Quinlan et al.
2014/0008394 A1 * 1/2014 Hofte ..... 222/190
2014/0061247 A1 * 3/2014 Arminak ..... A47K 5/14 222/190

FOREIGN PATENT DOCUMENTS

EP 0 950 434 A1 10/1999
KR 0163093 B1 11/1998

* cited by examiner

INVERTED SQUEEZE FOAMER

CROSS REFERENCE TO RELATED APPLICATIONS

This application is a continuation of International Application No. PCT/US2013/054889 filed Aug. 14, 2013, which claims the benefit of U.S. Provisional Application No. 61/695,525 filed Aug. 31, 2012, which are hereby incorporated by reference.

BACKGROUND

Various dispensing systems have been developed for dispensing a flowable product by means of manual actuation. The flowable product may be any one of a variety of health and beauty aid products or any one of a variety of home, kitchen and bath cleaning products. The type of manual actuation depends primarily on the construction of the dispensing system. Aerosols and similar pressurized containers are usually manually actuated by depressing a button. Dispensing systems employing a plunger construction are usually manually actuated by (downwardly) depressing an upwardly-extending actuator stem or post, often fitted with an ergonomic actuator. Also typical of such plunger constructions is the dispensing of the product out through the ergonomic actuator. This is similar to how an aerosol mist is dispensed out through an opening in the button which is depressed. This is also similar to how a spray mist would be dispensed. A flowable product may be dispensed as a mist, a spray, a liquid, a gel or a foam. While this listing may not be exhaustive, it does include the more common flowable product forms, compositions and consistencies.

The dispensing system constructions mentioned above each involve some type of direct manual manipulation of the dispensing mechanism. Even if one simply removes a threaded cap and pours out a portion of the product, there is still direct manual manipulation of the threaded cap. An alternative way of dispensing a flowable product is to provide a pliable container for the product and apply a manual squeezing force on the outer wall of the container in order to increase the interior pressure. This increased interior pressure forces a portion of whatever product is in the container to be dispensed through a dispensing outlet. While there is direct manual manipulation of the container wall, it is the interior pressure and the flow of air and product which actuate the dispensing structure and open any internal valves.

This general type or style of squeeze dispenser may be used to dispense product as a liquid or may be used to dispense the product as a foam composition or consistency which is an aerated mixture of liquid and air. The focus of the present disclosure, as shown by the exemplary embodiment, is directed to an inverted squeeze foamer. Two (2) species of the inverted squeeze foamer are disclosed herein as exemplary embodiments. One (1) species employs a duckbill valve for managing the flow of liquid product. The other species employs a metering valve for managing the flow of liquid product.

SUMMARY

The disclosed foam-dispensing system uses a pliable container (i.e. a squeeze bottle) for containing and storage of a liquid product. While the viscosity of the liquid product may vary based in part on its temperature, the use of "liquid" herein refers to alcohol-based products and other flowable products whose room temperature viscosity (μ) is preferably in the range of approximately between 1.0 centipoise and 150 centipoise. This range allows the selected liquid product to flow, to mix and to be dispensed with a foam consistency by way of the disclosed foam-dispensing system.

The term "system", as used herein, refers to the combination of the container, the product which is placed in the container and the dispensing mechanism which is attached to the container. The "system" is also referred to as a "squeeze foamer", due to the use of a squeezing force on the pliable wall of the container. One approach for attachment of the dispensing mechanism to the container is to provide a threaded neck on the container and threadedly connect the dispensing mechanism. A dip tube is typically extended into the product so as to be able to draw product into the dispensing mechanism. The dispensing mechanism is referred to herein as a "foamer". The referenced viscosity range for the product encompasses a number of different liquid products such as liquid soap, shaving cream, cleaning preparations, and hygiene products, to name simply a few of the possibilities.

One consideration in the design and construction of a foamer of the type generally discussed above is its cost and this relates in part to the number of component parts and the material expense for those component parts. Another consideration is the quality of the foam which is produced and dispensed. The produced foam needs to have some degree of fluidity to be easily dispensed. However, too much product in the mixture with air may result in a foam which is too runny and will not remain where it is applied. Too much air in the mixture can affect the fluidity of the foam and may cause the foam to be too dry. Controlling the volumetric ratio of liquid product and air is important in controlling the quality of the foam which is dispensed. A still further consideration is the reliability of the foamer construction. Included as part of this consideration is the integrity of any interior valves and their sealing effectiveness. A still further consideration is the ease of assembly. This may relate in part to the number of component parts, but also relates to the construction of those component parts and their manner of assembly and interfit with one another.

A still further consideration is the range of products which the foamer can accommodate. This degree of accommodation depends in part on the product viscosity and in part on the design of the component parts. The focus here is on the dimensions, sizes, lengths, etc. which influence the flow of liquid product and air and on the specific style of valving as represented by the two (2) species. With these considerations in mind, the disclosed embodiment provides an efficient and reliable structure which produces and dispenses an acceptable foam consistency for the product. The limited number of component parts assemble easily without the need for any bonding, ultrasonic welding or the use of threaded fasteners. The air flow for mixing with liquid product comes from the air within the container and the valving for the liquid product includes a duckbill valve in one embodiment and a metering valve in another embodiment. Use of the phrase "foam aeration" describes the process of pushing an air and liquid product mixture through a mesh screen. This mixture may be the two (2) constituents as initially mixed or may be the two (2) constituents after a first pass through a coarse mesh.

DESCRIPTION OF THE SELECTED EMBODIMENTS

Figure 1A:
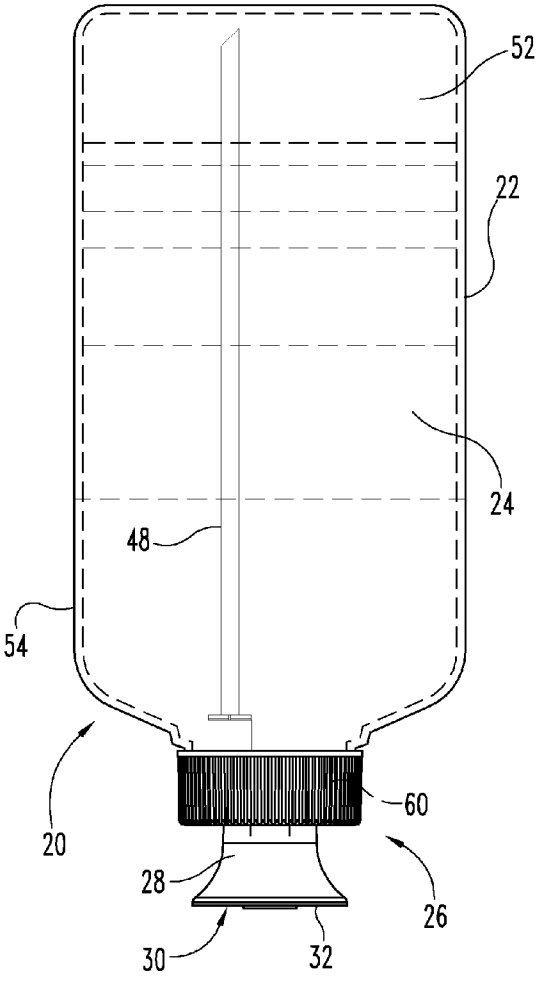
FIG. 1A is a front elevational view of the FIG. 1 inverted squeeze foamer in its inverted, use orientation.
Figure 2:
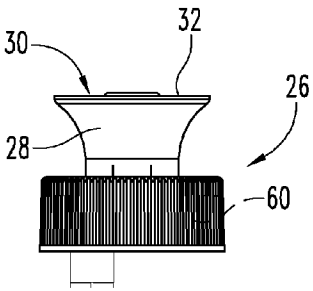
FIG. 2 is a front elevational view of a foamer, without the dip tube, in a closed condition, which comprises, as a subassembly, one part of the FIG. 1 inverted squeeze foamer.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity.

Figure 1:
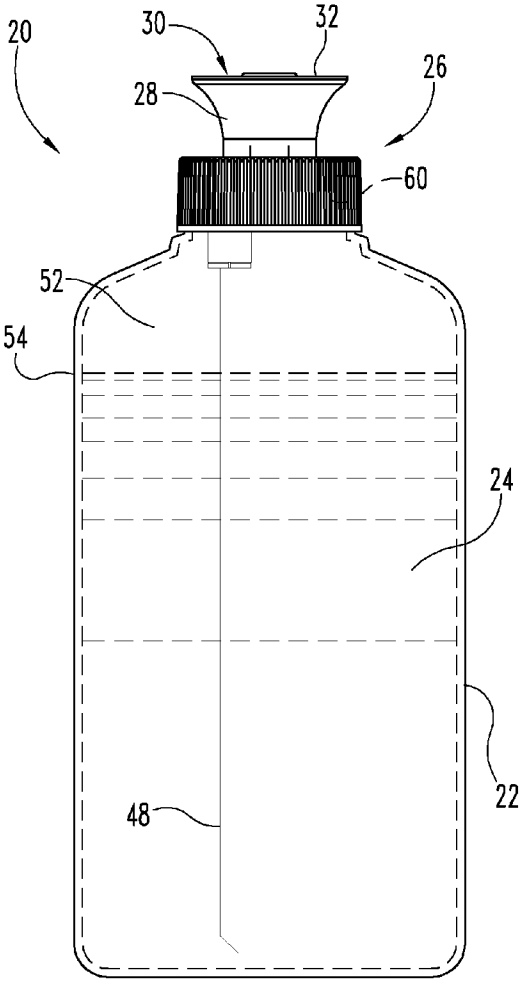
FIG. 1 is a front elevational view of an inverted squeeze foamer, in an upright orientation, according to a first embodiment.
Figure 3:
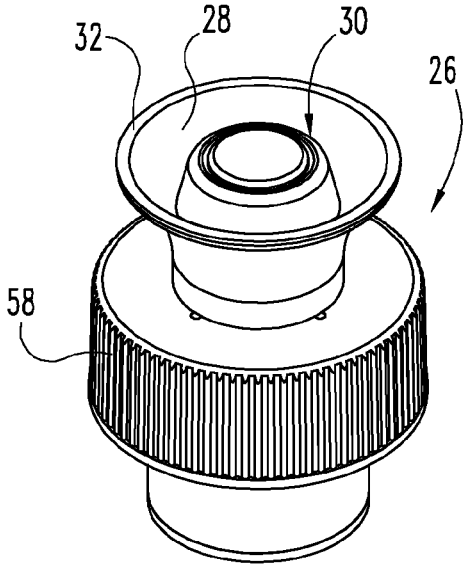
FIG. 3 is a perspective view of the FIG. 2 foamer.
Figure 4:
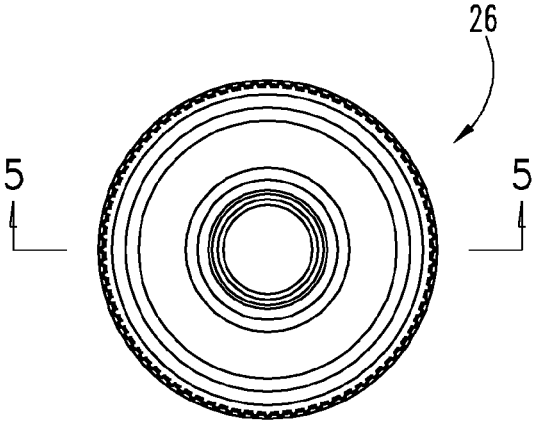
FIG. 4 is a top plan view of the FIG. 2 foamer.
Figure 5:
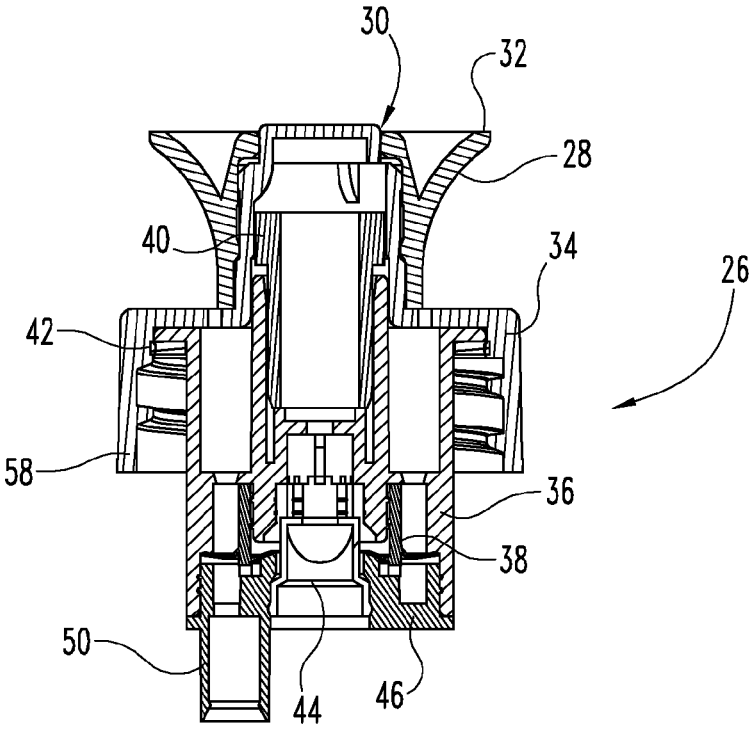
FIG. 5 is a front elevational view, in full section, of the FIG. 2 foamer, with a portion of the dip tube added, as viewed along cutting plane 5-5 in FIG. 4.

Referring to FIG. 1 there is illustrated an inverted squeeze foamer 20 which includes container 22, a supply of liquid product 24 and foamer 26. In terms of production, marketing and sales for squeeze foamer 20 and its constituents, a completed squeeze foamer 20, filled with product 24, could be sold in that completed condition to a distributor, to a wholesaler or to a discount or retail outlet. The container 22 and foamer 26 could be sold as a combination, without product, to a filler. Another option, when the filler has the container 22 supplied by another entity, is to sell only the foamer 26. FIG. 1 shows the entire inverted squeeze foamer 20 including container 22 and liquid product 24. However, the focus of this disclosure and of the exemplary embodiment is on the foamer 26.

The exemplary embodiment, as illustrated herein, is described as being an "inverted" squeeze foamer. In order to properly orient the disclosed inverted squeeze foamer, its normal, not in use condition is with the base of the container resting on a shelf, countertop or similar substantially horizontal surface. However, since the top cap 28 which is adjacent the dispensing end 30 has a substantially planar lower edge 32, the inverted squeeze foamer 20 can be set, when not in use, on edge 32. This inverted, at rest condition is illustrated in FIG. 1A. The dispensing end 30 is thus oriented, in the FIG. 1 condition, as the highest or uppermost portion of the inverted squeeze foamer. The inverted squeeze foamer, in this condition, has a longitudinal axis which is substantially vertical. The use of "inverted" refers to the fact that when the user desires to dispense a portion of the liquid product 24, as foam or with a foam consistency, the inverted squeeze foamer is inverted such that the base of container 22 is above (i.e. higher) than dispensing end 30. One reason for inverting is due to the manner and direction in which the foamed product is dispensed. In brief, the use of "inverted" is intended to also clarify and to differentiate this general style of dispenser from that category or style of dispenser which is typically referred to as "upright".

Referring now to FIGS. 2-9, the structural details and component part relationships of foamer 26 are illustrated. Foamer 26, in addition to top cap 28, includes closure 34, housing 36, diaphragm 38, mesh insert 40, annular gasket 42, duckbill valve 44, duckbill valve holder 46 and dip tube 48. The dip tube 48 can be considered a part of foamer 26 or can be considered a separate component part. One reason to perhaps consider the dip tube 48 as a separate component part is the ability and the option of exchanging dip tubes in order to change the size of the inside diameter as this would affect the volumertric flow rate of the air. The positional and assembly relationships of the component parts which comprise foamer 26 are illustrated in FIGS. 2-5 and 9.

These component parts 28, 34, 36, 38, 40, 42, 44, 46 and 48 are assembled together without using any adhesives, bonding agents, threaded fasteners or the use of ultrasonic welding. An axial, sliding relationship between cap 28 and closure 34 defines, in part, dispensing end 30. By pulling axially on cap 28, in a direction which is outwardly or upwardly, a foam flow opening between cap 28 and closure 34 is created allowing generated foam to be dispensed as the pliable container 22 is squeezed.

Mesh insert 40 is received in part by housing 36 and in part by closure 34. Portions of housing 36 are received by closure 34. Closure 34 is constructed and arranged to assemble to the neck of the container 22. The duckbill valve 44 assembles into duckbill valve holder 46 and this combination is received by housing 36. The duckbill valve holder 46 includes a dip tube sleeve 50 which receives the dip tube 48 with an interference fit. The diaphragm 38 is positioned above the duckbill holder 46 and includes an upper annular wall which received a lower annular wall of the housing 36. The gasket 42 is positioned so as to help seal the threaded assembly closure 34 with the neck of the container. Gasket 42 is preferably a square cut annular gasket, but alternatively could be an O-ring.

Figure 6:
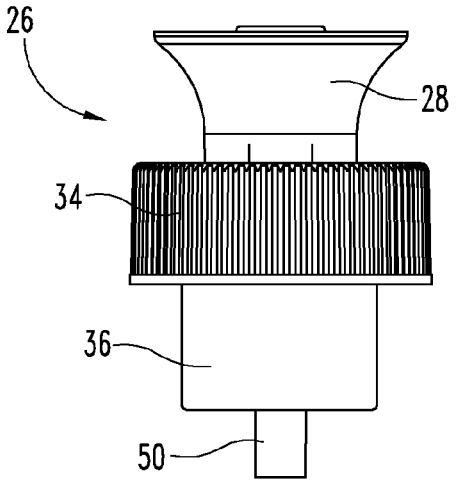
FIG. 6 is a front elevational view of the FIG. 2 foamer in an open condition.
Figure 7:
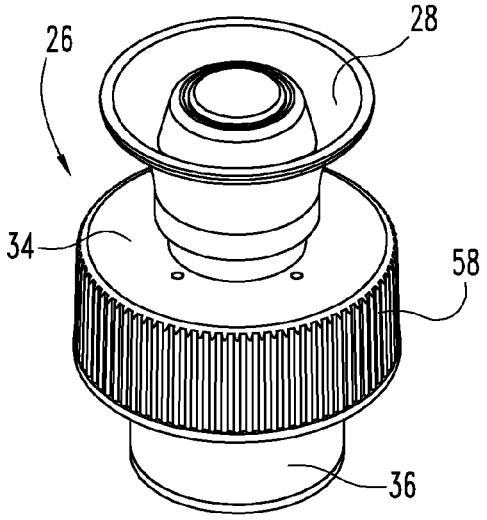
FIG. 7 is a perspective view of the FIG. 6 foamer.
Figure 8:
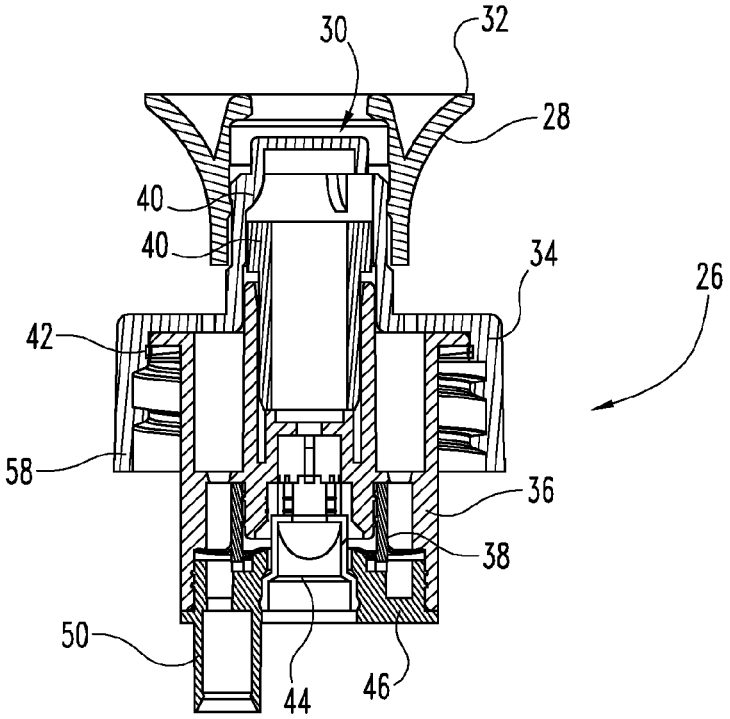
FIG. 8 is a front elevational view, in full section, of the FIG. 6 foamer, viewed in the same plane as FIG. 5.

FIGS. 2-5 show the foamer 26 in a closed, at rest condition, not yet inverted. FIGS. 6-8 show the foamer 26 in an open, at rest condition, ready for foam dispensing out of dispensing end 30, once the foamer is inverted. In order to proceed with the dispensing of foam, the inverted squeeze foamer 20 should be inverted, see FIGS. 1A and 9, so that liquid product flows through duckbill valve 44 and so that the free end of the dip tube 48 is in communication with the air 52 (air pocket) in container 22 which is above the level of liquid product 24 in the inverted orientation of FIG. 1A. With the exception of duckbill valve 44 and duckbill valve holder 46, each component part 28, 34, 36, 38, 40, 42 and 48 is generally symmetrical about a diametrical cutting plane.

Briefly, the manual squeezing of the container 22 so as to draw generally opposing portions of the pliable sidewall 54 closer together (see FIG. 1A), causes an increase in the internal pressure. This increase in the internal pressure creates an air flow via dip tube 48 and creates a flow of the liquid product 24 downwardly through the duckbill valve 44. With continued reference to FIG. 1A, there is an air pocket with air 52 in container 22 which is located above the volume of liquid product 24. As the opposing portions of the container sidewall 54 are squeezed together, the volume of the container is reduced and the internal forces which are generated cause the trapped air to try and find an exit path of least resistance. This internal pressure also causes the liquid product to try and find an exit path of least resistance. These two (2) flows of air and liquid product are combined and pushed through the mesh insert 40 thereby creating a foam consistency for the liquid product 24. The foam exits via the dispensing channel 56 which is defined by closure 34.

Figure 9:
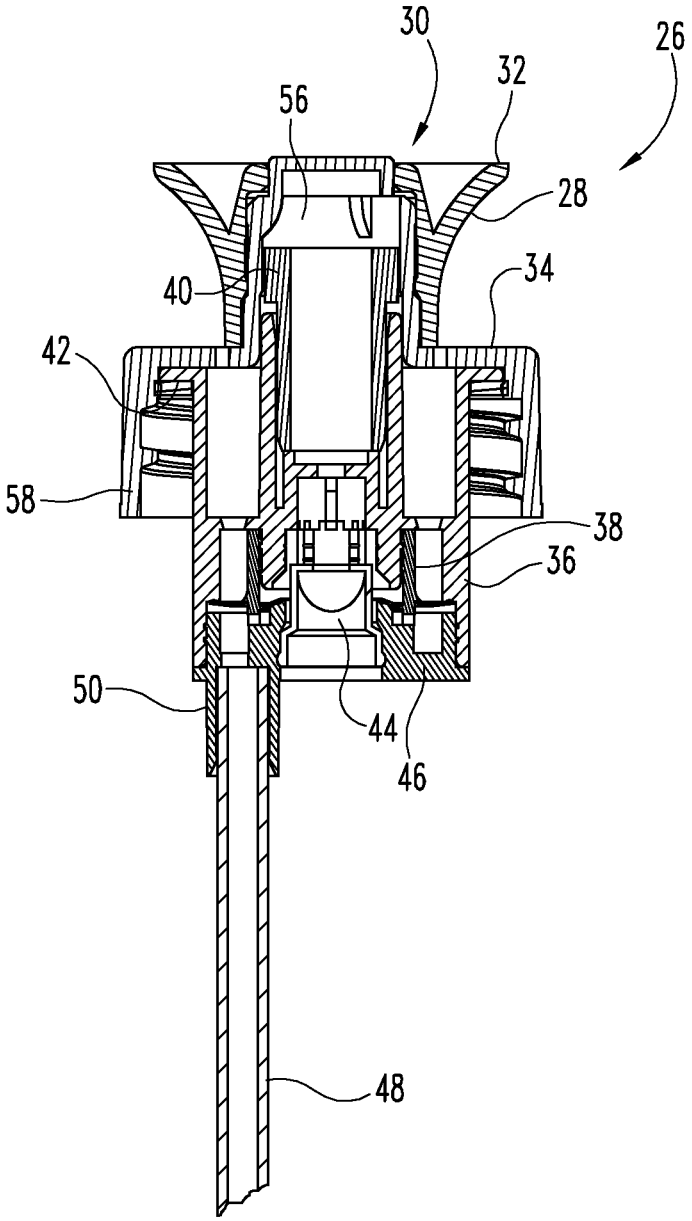
FIG. 9 is an enlarged, front elevational view, in full section, of the FIG. 5 structure.
Figure 10:
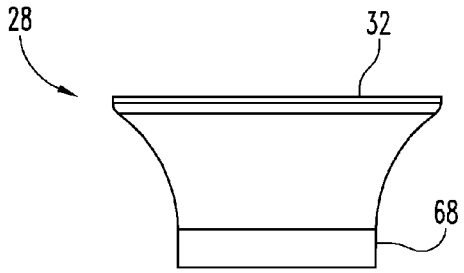
FIG. 10 is a front elevational view of a top cap which comprises one component part of the FIG. 2 foamer.
Figure 11:
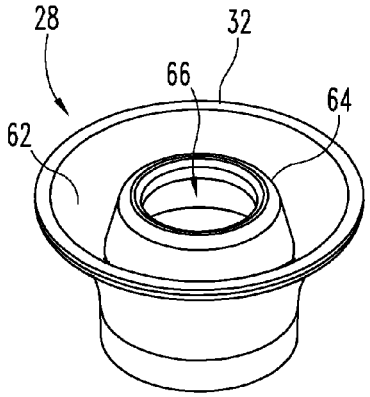
FIG. 11 is a perspective view of the FIG. 10 top cap.
Figure 12:
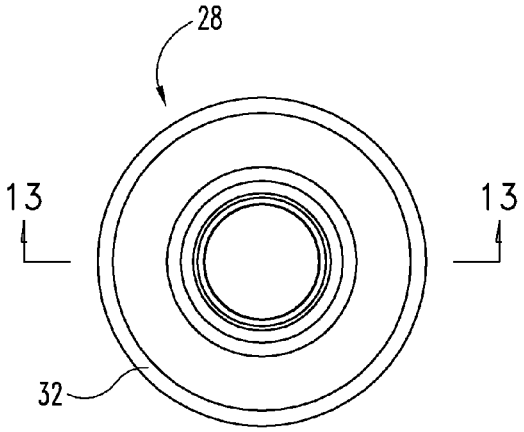
FIG. 12 is a top plan view of the FIG. 10 top cap.
Figure 13:
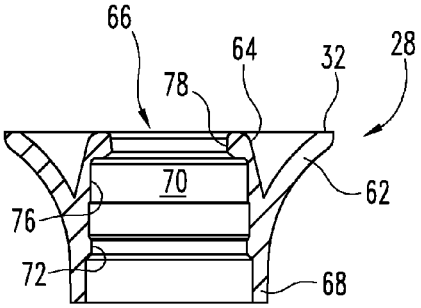
FIG. 13 is a front elevational view, in full section, of the FIG. 10 top cap, as viewed along cutting plane 13-13 in FIG. 12.
Figure 14:
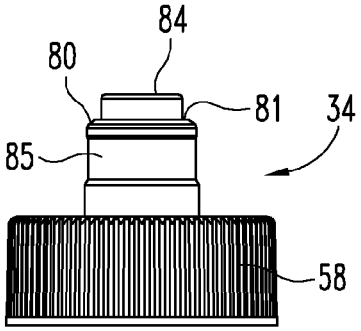
FIG. 14 is a front elevational view of a closure which comprises one component part of the FIG. 2 foamer.
Figure 15:
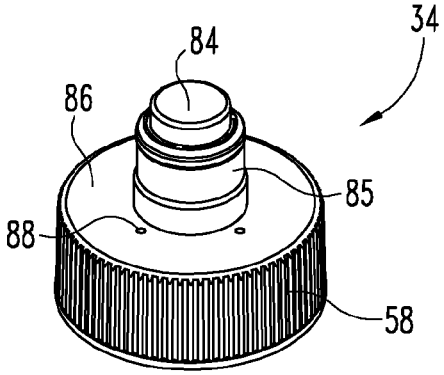
FIG. 15 is a perspective view of the FIG. 14 closure.
Figure 16:
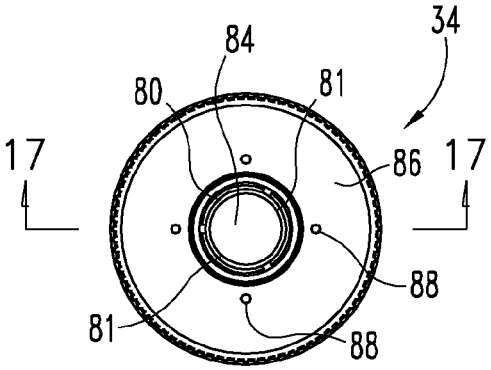
FIG. 16 is a top plan view of the FIG. 14 closure.
Figure 17:
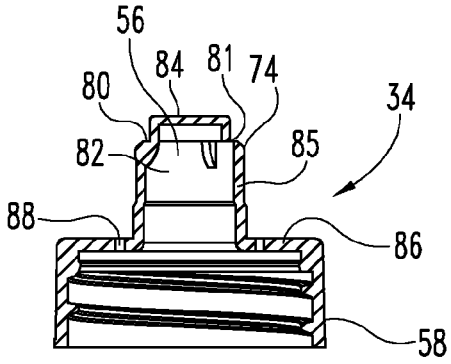
FIG. 17 is a front elevational view, in full section, of the FIG. 14 closure, as viewed along cutting plane 17-17 in FIG. 16.
Figure 18:
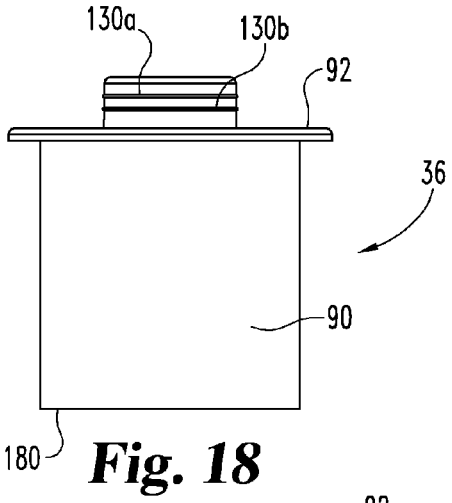
FIG. 18 is a front elevational view of a housing which comprises one component part of the FIG. 2 foamer.
Figure 19:
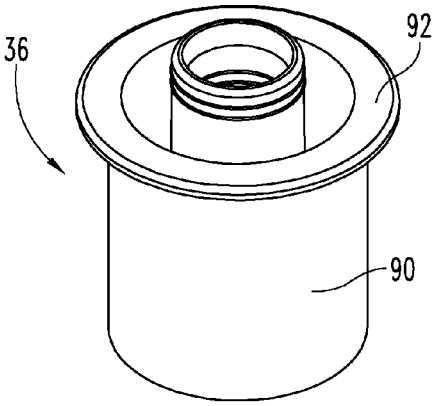
FIG. 19 is a perspective view of the FIG. 18 housing.
Figure 20:
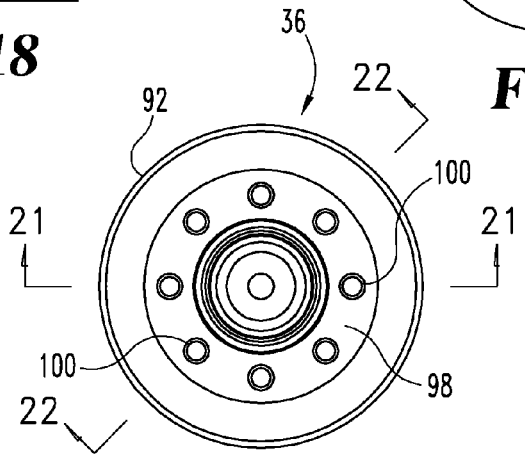
FIG. 20 is a top plan view of the FIG. 18 housing.
Figure 21:
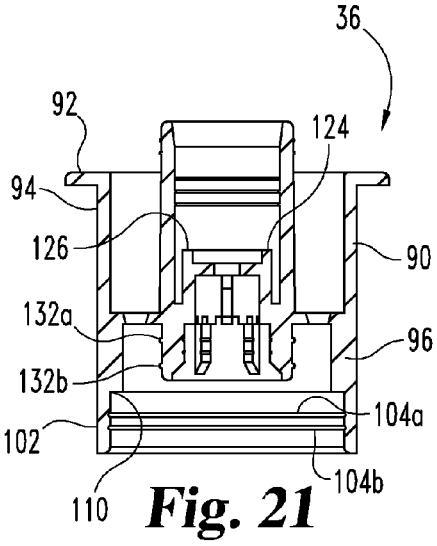
FIG. 21 is a front elevational view, in full section, of the FIG. 18 housing, as viewed along cutting plane 21-21 in FIG. 20.
Figure 22:
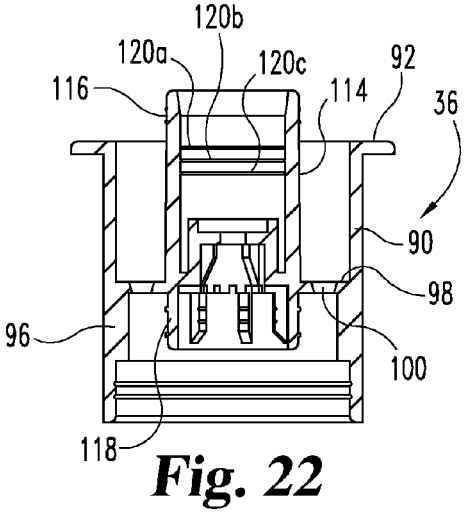
FIG. 22 is a side elevational view, in full section, of the FIG. 18 housing, as viewed along cutting plane 22-22 in FIG. 20.
Figure 23:
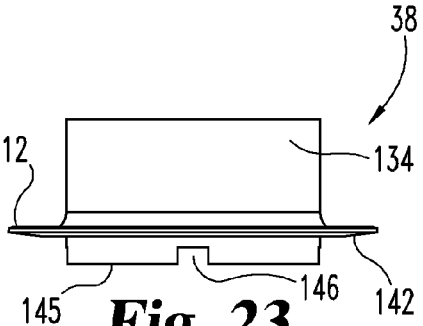
FIG. 23 is a front elevational view of a diaphragm which comprises one component part of the FIG. 2 foamer.
Figure 24:
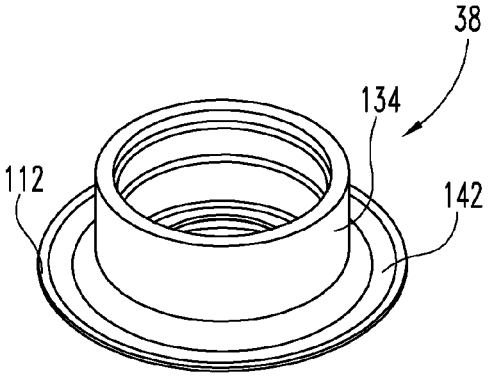
FIG. 24 is a perspective view of the FIG. 23 diaphragm.
Figure 25:
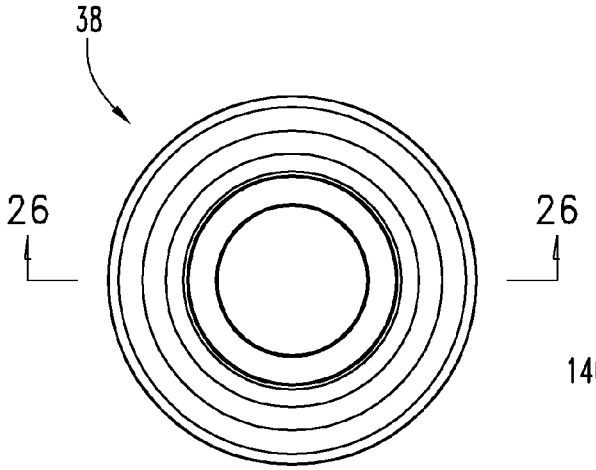
FIG. 25 is a top plan view of the FIG. 23 diaphragm.
Figure 26:
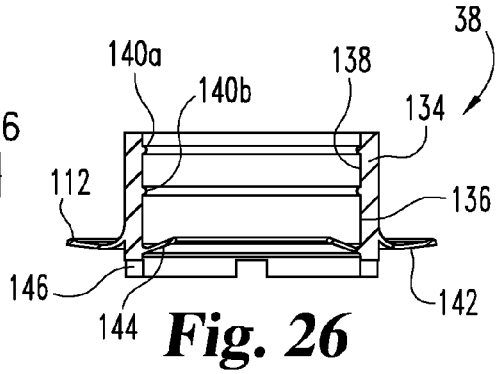
FIG. 26 is a front elevational view, in full section, of the FIG. 23 diaphragm, as viewed along cutting plane 26-26 in FIG. 25.
Figure 27:
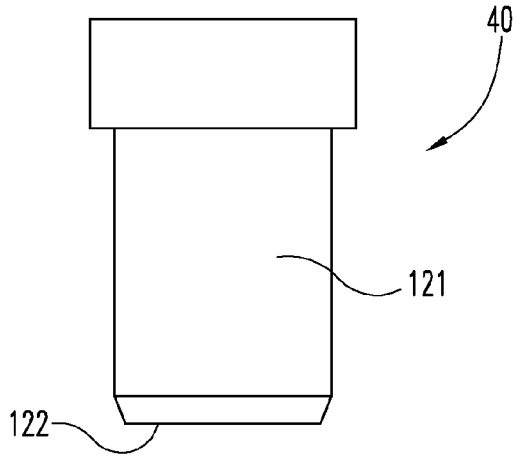
FIG. 27 is a front elevational view of a mesh insert which comprises one component part of the FIG. 2 foamer.
Figure 28:
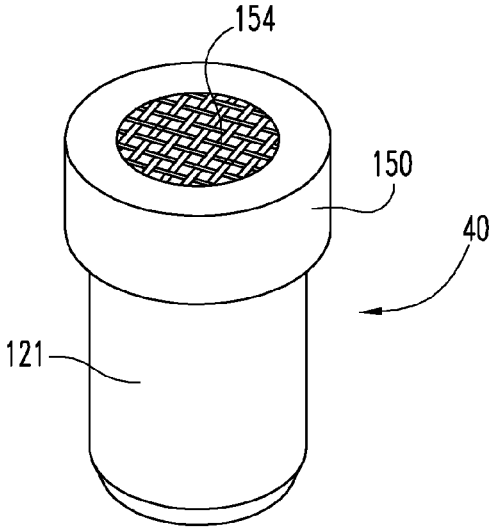
FIG. 28 is a perspective view of the FIG. 27 mesh insert.
Figure 29:
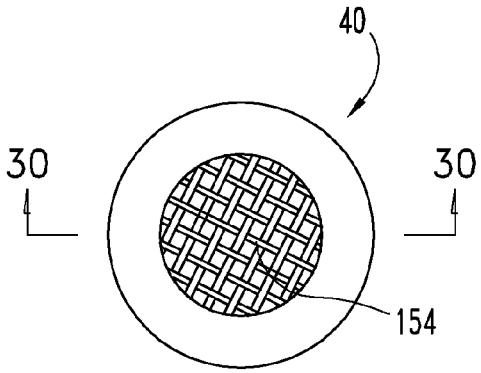
FIG. 29 is a top plan view of the FIG. 27 mesh insert.
Figure 30:
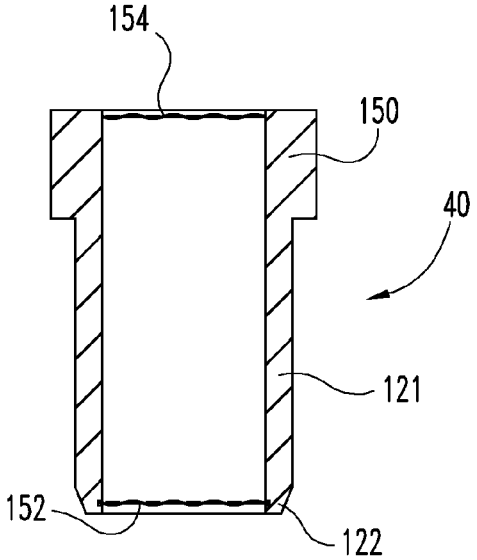
FIG. 30 is a front elevational view, in full section, of the FIG. 27 mesh insert, as viewed along cutting plane 30-30 in FIG. 29.
Figure 31:
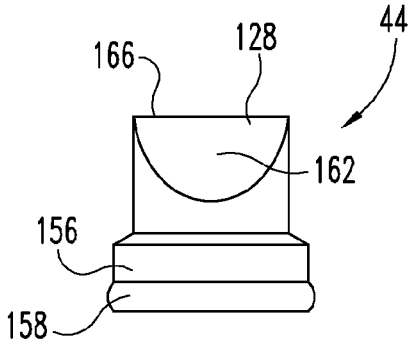
FIG. 31 is a front elevational view of a duckbill valve which comprises one component part of the FIG. 2 foamer.
Figure 32:
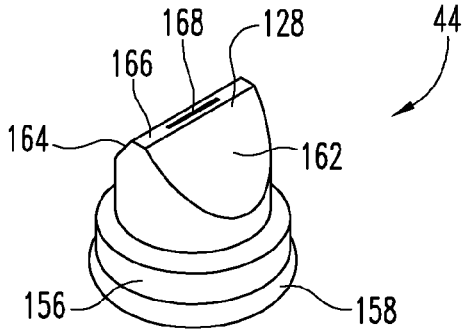
FIG. 32 is a perspective view of the FIG. 31 duckbill valve.
Figure 33:
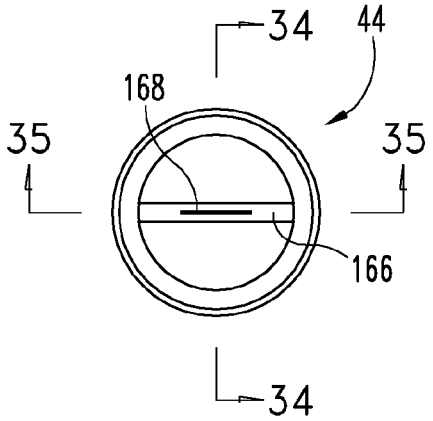
FIG. 33 is a top plan view of the FIG. 31 duckbill valve.
Figure 34:
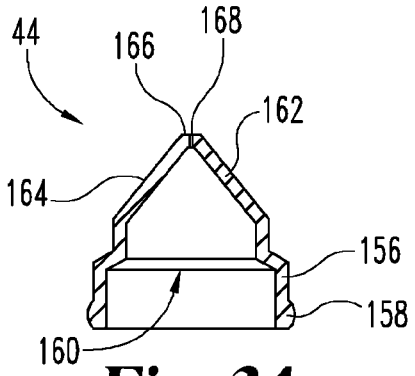
FIG. 34 is a side elevational view, in full section, of the FIG. 31 duckbill valve, as viewed along cutting plane 34-34 in FIG. 33.
Figure 35:
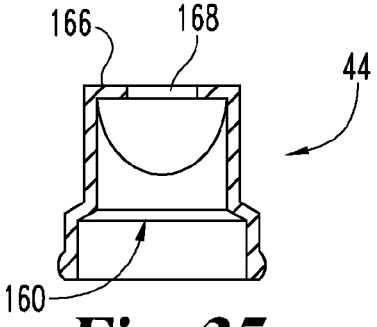
FIG. 35 is a front elevational view, in full section, of the FIG. 31 duckbill valve, as viewed along cutting plane 35-35 in FIG. 33.
Figure 36:
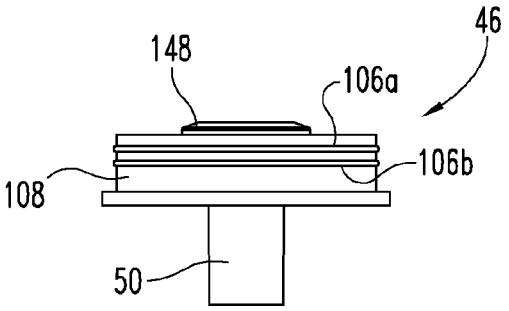
FIG. 36 is a side elevational view of a duckbill holder which comprises one component part of the FIG. 2 foamer.
Figure 37:
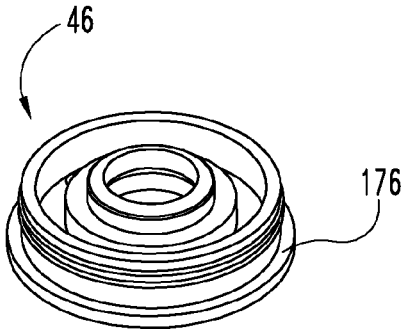
FIG. 37 is a perspective view of the FIG. 36 duckbill holder.
Figure 38:
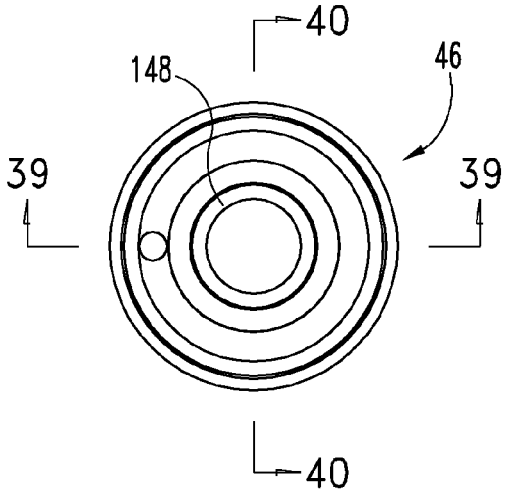
FIG. 38 is a top plan view of the FIG. 36 duckbill holder.
Figure 39:
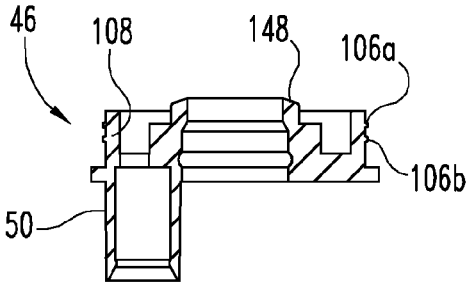
FIG. 39 is a front elevational view, in full section, of the FIG. 36 duckbill holder, as viewed along cutting plane 39-39 in FIG. 38.
Figure 40:
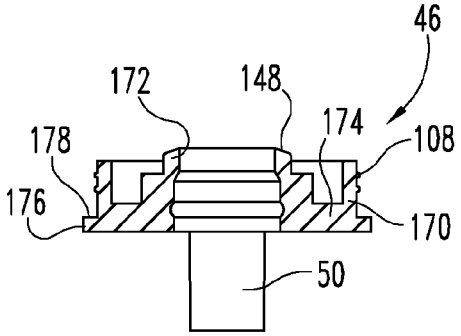
FIG. 40 is a side elevational view, in full section, of the FIG. 36 duckbill holder, as viewed along cutting plane 40-40 in FIG. 38.
Figure 41:
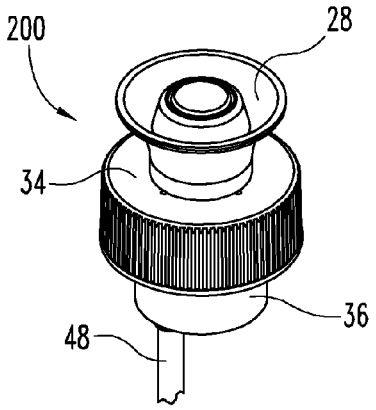
FIG. 41 is a perspective view of an alternate embodiment of a foamer which is suitable for use, as a subassembly, as one part of the FIG. 1 inverted squeeze foamer.
Figure 42:
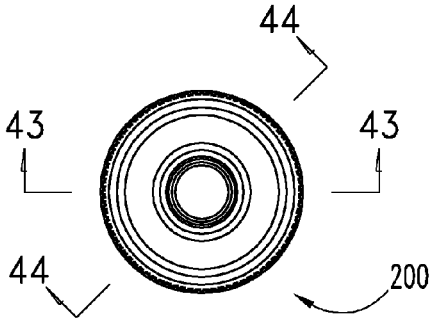
FIG. 42 is a top plan view of the FIG. 41 foamer.
Figure 43:
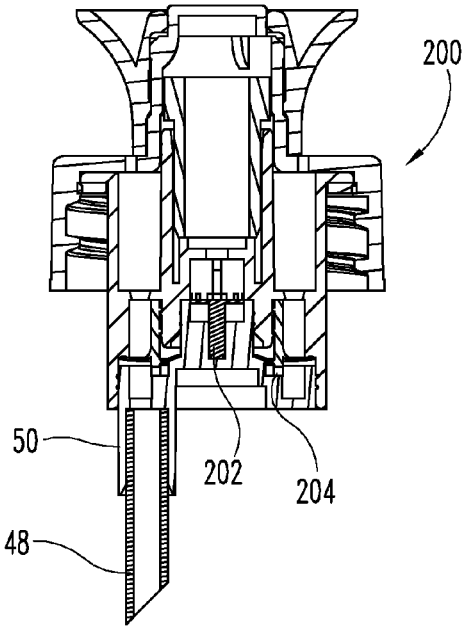
FIG. 43 is a front elevational view, in full section, of the FIG. 41 foamer, as viewed along cutting plane 43-43 in FIG. 42.
Figure 44:
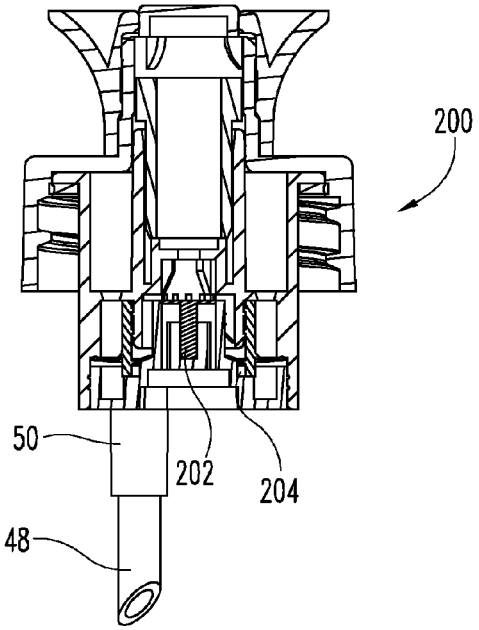
FIG. 44 is an angled side elevational view, in full section, of the FIG. 41 foamer, as viewed along cutting plane 44-44 in FIG. 42.

With continued reference to FIG. 9, an enlarged view of foamer 26 is illustrated. In use this orientation would be inverted. Only a portion of the dip tube 48 is shown in order to focus on the details of the other component parts. The specific flow path for the air, when inverted, is in and down through dip tube 48. The specific flow path for liquid product 24, when inverted, is into the upper end of the duckbill valve 44. The internal pressure creates a sufficient liquid flow force to open the valve and thereby allow the air and liquid product to mix before that mixture is pushed through mesh insert 40.

The closure 34 includes a lower, generally cylindrical skirt 58 which is internally threaded for threaded connection to the threaded neck 60 of container 22. The exemplary embodiment shows internal threads on the skirt 58 and there are cooperating external threads on the neck 60. However, it is contemplated that this form of threaded engagement could be reversed. Alternatively, the foamer 26 and container 22 could be securely assembled together, into a leak-free combination, by means of a snap-fit combination or an interference fit. Techniques such as the use of ultrasonic welding or the use of adhesives are not suitable since as a practical matter they can only be employed after the container is filled with liquid product.

Cap 28, as a separate component part, is illustrated in FIGS. 10-13. Cap 28 includes an annular, flared outer wall 62 and an inner, annular wall 64 which defines annular opening 66. Wall 62 curves inwardly, in a "downward" direction to free end 68 which defines the generally annular interior 70. The use of directional references, such as "downwardly", in the description of the component part is based on the FIG. 1 orientation (at rest) of inverted squeeze foamer 20.

Inwardly directed rib 72 is an abutment stop for the relative movement between cap 28 and closure 34. Closure 34 includes a radially outwardly-extending rib 74 which slides against the interior annular surface 76 of cap 28. Annular lip 78 abuts against ledge 80 when cap 28 and closure 34 are "closed". This abutment between lip 78 and ledge 80 closes off any foam flow openings or separation, effectively sealing closed the foamer 26. In the "open" condition of FIG. 8, there are open pathways 81 out of chamber 82 and around tip 84 for the flow of the foam which is produced by the mesh insert 40.

Closure 34, as separate component part, is illustrated in FIGS. 14-17. Closure 34 includes, in addition to those structural portions already described, a threaded body including skirt 58, an annular stem 85 and an annular upper shelf 86 positioned between stem 85 and skirt 58 which defines an equally-spaced pattern of four (4) air openings 88 which supply make-up air into the container 22.

The valving structure of diaphragm 38 helps to control when and how make-up air is drawn into container 22 after a portion of liquid product 24 is dispensed with a foam consistency. Briefly, internal pressure due to squeezing of the pliable container sidewall 54 causes an inner edge portion of the diaphragm 38 to push open for delivering air in order to mix with the liquid product. When the squeezing force on the sidewall of the container is removed, the container tries to return to its original shape. This in turn creates a suction force and an outer edge portion or portions of the diaphragm 38 pull away from its valve seat (part of housing 36) and air is sucked into the container via openings 88. Additional details of this described air flow are provided later in conjunction with a description of other component parts.

Housing 36, as a separate component part, is illustrated in FIGS. 18-22. Housing 36 includes an internally-stepped or offset outer wall 90 extending integrally into upper radial flange 92. The outer surface 94 of outer wall 90 is generally cylindrical. The radial flange 92 is generally cylindrical and generally concentric with outer wall 90. Inwardly offset portion 96 is generally cylindrical and integrally extends into intermediate annular shelf 98. Shelf 98 defines an equally-spaced pattern of eight (8) make-up air openings 100. The flow of make-up air which enters via openings 88 continues through openings 100 and past diaphragm 38 in order to flow into container 22 (see FIG. 9). This incoming flow of make-up air must enter the container via dip tube 48.

Lower wall portion 102 is generally cylindrical and defines two (2) annular recessed grooves 104*a* and 104*b* which function as snap-fit detents in cooperation with raised annular ribs 106*a* and 106*b* (annular bumps) on the outer surface of outer wall 108 of duckbill holder 46 for a snap-fit assembly between these two (2) component parts (see FIG. 9). The annular ledge 110 which corresponds to the radial offset between portion 96 and wall 102 provides the valve seat 110 for the outer edge portion 112 of the diaphragm 38.

Interior sleeve 114 which is integral with shelf 98 is generally cylindrical and generally concentric with outer wall 90. Sleeve 114 includes an upper portion 116 axially above shelf 98 and a lower portion 118 axially below shelf 98. Upper portion 116 includes three (3) small raised (radially inwardly) annular ribs 120*a*, 120*b* and 120*c* for an interference fit with the outer cylindrical wall 121 of mesh insert 40. The lower surface or edge 122 of mesh insert 40 abuts up against upper surface 124 of mix portion 126. The interior space or volume defined by mix portion 126 allows initial mixing of the air flow and the portion of liquid product 24 being withdrawn from container 22. Lower portion 118 receives the upper (tapered) tip 128 of duckbill valve 44 (see FIG. 9). Clearance is provided between lower portion 118 and duckbill valve 44 for the flow of air from within the container 22 for mixing with the flow of liquid product which flows through duckbill valve 44. The interior shapes, openings, clearances, etc. of mix portion 126 and of lower portion 118 are each constructed and arranged in order to facilitate the desired and intended flows of air and of liquid product and the desired and intended mixing of those two (2) flows before being pushed through the mesh insert 40 for foam aeration and for creating a desired foam consistency for the liquid product for dispensing.

The raised annular ribs 130*a* and 130*b* on the outer surface of upper portion 116 are used to facilitate and secure the interference fit of the axially upper end of portion 116 into stem 85 of closure 34. The raised annular ribs 132*a* and 132*b* on the outer surface of lower portion 118 are used to facilitate and secure the snap-fit assembly of lower portion 118 into the upper end 134 of the generally cylindrical body 136 of diaphragm 38. The inner surface 138 defines a pair of raised annular ribs 140*a* and 140*b* which are constructed and arranged to cooperate with ribs 132*a* and 132*b* for the snap-fit (snap-over) assembly.

Disclosed herein are several snap-fit and/or interference fit assemblies between two (2) component parts or at least between portions of the two (2) component parts. Typically these component part portions are generally cylindrical and include or define some type of assembly structure. Described thus far are raised annular ribs, usually a plurality, and recessed annular grooves or what would be described as detents in a more functional sense.

It is to be understood that virtually any assembly technique or combination may be used for virtually any portion of the exemplary embodiments. These options include the following. One option is to provide one (1) or more raised annular ribs on one (1) part and one (1) or more recessed annular grooves on the other part. The snap-fit of the ribs into the grooves, similar to a ball and detent, helps to secure the assembly of these two (2) component parts. This assembly technique may be used with closely sized parts which may also provide a sliding fit or even an interference fit in addition to the rib-groove interfit.

Another option is to provide only the one (1) or more raised annular ribs on one of the parts. The mating part simply provides a closely sized and similarly shaped surface which creates an interference fit or perhaps a close sliding fit relative to the raised annular ribs. When an interference fit exists, this interference fit actually anchors the two (2) parts together. With plastic parts, and depending on the degree of interference, the ribs may actually "indent" into the other part thereby adding a type of interlock to the assembly.

A still further option is to provide one (1) or more raised annular ribs on each part. This arrangement has the rib or ribs on one part snapping over one or more of the ribs on the other part. There is dimensional interference based in the diameter sizes of the ribs requiring axial force for the snap-together or snap-over assembly of the two (2) component parts.

Diaphragm 38, as a separate component part, is illustrated in FIGS. 23-26. Diaphragm 38 includes, in addition to those portions already described, an annular sealing flange 142 with a flexible annular inner lip 144 and a lower, generally cylindrical edge 145 defining four (4), spaced-apart air flow notches 146. Air flowing from the container via dip tube 48 flows through the notches 146 and pushes open (i.e. lifts) inner lip 144 for the air flow to reach mix portion 126. As described, edge portion 112 functions as a valve seal and ledge 110 functions as the cooperating valve seat for the flow of make-up air. Similarly, inner lip 144 functions as a valve seal and the upper annular edge 148 of holder 46 functions as the cooperating valve seat for the flow of air from container 22 for foam aeration. Lip 144 is shaped with a slight incline and edge 148 has a similar slight incline. Edge portion 112 is also shaped with a slight incline. In the "at rest" condition with the container placed on a support surface, these slight inclines are in an axially upward direction. In the inverted condition of the squeeze foamer 20, when it is intended to dispense foam, these slight inclines are in an axially downward direction.

Mesh insert 40, as a separate component part, is illustrated in FIGS. 27-30. In addition to those portions already described, mesh insert 40 includes an enlarged portion 150 which is generally cylindrical and generally concentric with wall 121. Edge 122 defines an opening which receives a coarse mesh screen 152. Portion 150 defines an opening which receives a fine mesh screen 154.

In the exemplary embodiment two (2) mesh screens are provided and these two (2) mesh screens 152 and 154 are incorporated into mesh insert 40. Alternatively, additional mesh screens can be used or the foamer could include a single mesh screen. Further, in addition to or in lieu of insert 40, the mesh screens can be integrated into other component parts of the foamer, such as into closure 34 and/or housing 36. This integration may be an integrally molded combination or a snap-in assembly of the mesh screen into the other part or a press-in or interference fit assembly. In the exemplary embodiment mesh screens 152 and 154 are installed into the hollow interior of the mesh insert body. Alternatively, each mesh screen 152 and 154 may be bonded to their corresponding end faces of the mesh insert body.

Duckbill valve 40, as a separate component part, is illustrated in FIGS. 31-35. Duckbill valve 44 includes in addition to tip 128, a base 156 which includes an annular enlarged portion 158 for a snap-fit assembly into holder 46. The tip 128 and base 156 cooperatively define a hollow interior 160. Tip 128 includes flat tapered sides 162 and 164 which converge toward upper edge 166. Edge 166 defines a slit 168 whose sides or edges separate to enlarge the opening in response to a flow of liquid product through interior 160. In a reverse direction, slit 168 is essentially closed to any type of reverse flow of liquid product or foam.

Duckbill valve holder 46, as a separate component part, is illustrated in FIGS. 36-40. In addition to those portions already described, holder 46 includes an outer annular wall 170, an inner annular wall 172 and an annular connecting portion 174. Wall 170 integrally extends into annular flange 176 which extends radially outwardly of wall 170 and thereby defines an abutment surface 178 which cooperates with the lower edge 180 of lower wall portion 102 of housing 36.

As a brief recap, referring to the inverted, ready-to-dispense orientation of FIG. 1A, the dispensing of the liquid product 24 with a foam consistency begins in the inverted orientation with cap 28 moved to an "open" condition relative to closure 34. The next step or event is the manual squeezing of the pliable sidewall 54 of container 22. In this orientation, the liquid product is in direct contact with foamer 26 and the open, free end of the dip tube 48 is positioned in the air 52 pocket or air volume which is above the volume of liquid product 24.

This manual squeezing force creates an internal pressure within container 22 and this pressure causes two (2) flows. One (1) flow is of the liquid product 24 into duckbill valve 44 and the other flow is of air through dip tube 48. These two (2) flows mix in the vicinity of mix portion 126 and this mixture is then forced or pushed through the mesh insert 40. The air-liquid product mixture undergoes a first foam aeration step as it is pushed through coarse mesh screen 152 and then undergoes a second foam aeration step as the coarse foam is pushed through the fine mesh screen 154. The foam exiting from the mesh insert 40 is then dispensed.

When the squeezing force on the container is released, the pliable nature of the container sidewall causes that sidewall to try and return to its original state or prior status. As the sidewall expands, a suction force is created internally as well as through dip tube 48 which thereby opens the air valve which is provided by the combination of edge portion 112 and ledge 110. This allows a flow of make-up air to enter the container and this flow of make-up air continues until the internal pressure within container 22 is restored or returned to substantially atmospheric pressure. Once a generally atmospheric pressure is restored to the interior container 22, the diaphragm seals closed back to its starting or at rest condition. In terms of the make-up air back into the container, the vent flow rate is between approximately 0.01 liters per minute and 0.10 liters per minute at a differential pressure of 40 mbar (0.58 psi).

One feature of the present disclosure and of the illustrated exemplary embodiments is the ability to easily assemble the component parts into the final foamer 26 construction. The same is true for the second embodiment of foamer 200 which is described herein. This ease of assembly feature begins with the snap-fit or interference fit (these variations and their interchangeable aspects have been explained) assembly of four (4) component parts into a first subassembly. This first subassembly provides the assembly of the housing 36, the mesh insert 40, the diaphragm 38 and gasket 42. The second subassembly provides the assembly of the duckbill valve 44 and holder 46. The third subassembly puts the first two (2) subassemblies together in combination with the top cap 28. The final assembly step is to insert the dip tube 48 into sleeve 50 thereby converting the third subassembly into the final foamer construction. These assembly and subassembly steps in the sequence described above are applicable to both the first embodiment and the second embodiment. As noted, foamer 200 represents the second embodiment and the only relevant or applicable difference between foamer 26 and foamer 200 is the elimination of duckbill valve 44 and holder 46 from foamer 26 and replacement with a metering valve 202 and a different style of holder 204 as part of foamer 200. Except for these differences, the two (2) foamers 26 and 200 are essentially the same in all other important aspects.

Figure 45:
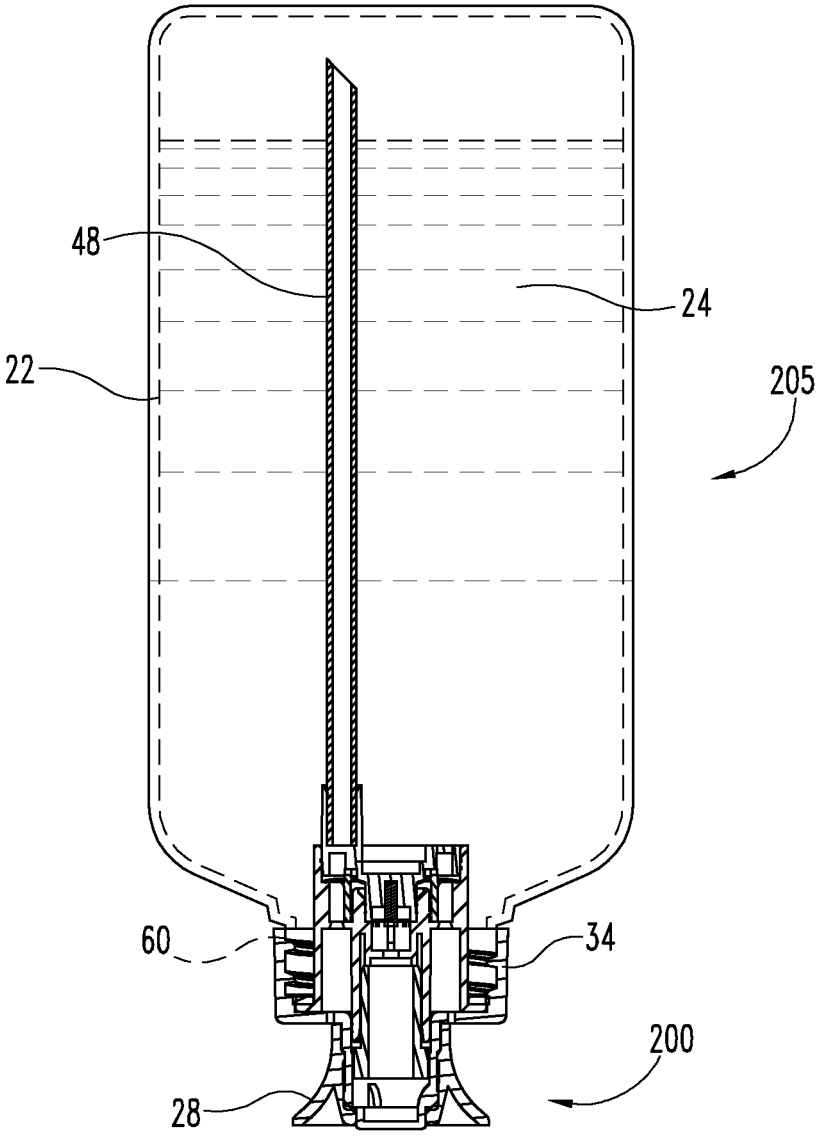
FIG. 45 is a front elevational view, in full section, of the FIG. 41 foamer as assembled to the FIG. 1 container, with liquid product.
Figure 46:
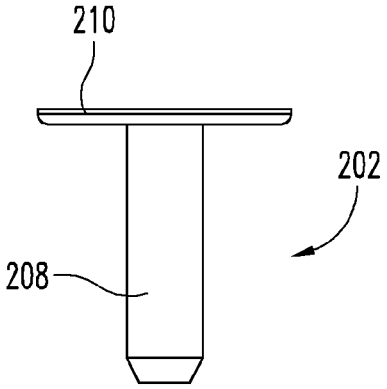
FIG. 46 is a front elevational view of a metering valve which comprises one component part of the FIG. 41 foamer.
Figure 47:
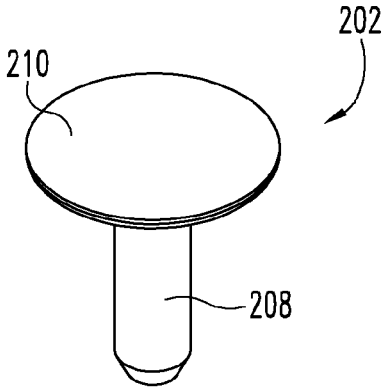
FIG. 47 is a perspective view of the FIG. 46 metering valve.
Figure 48:
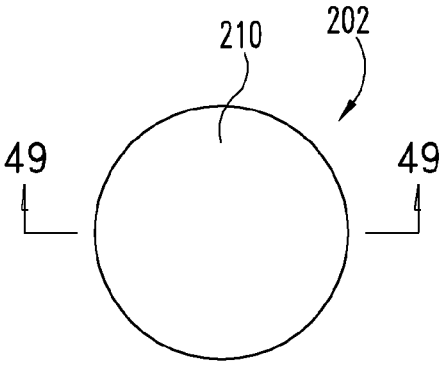
FIG. 48 is a top plan view of the FIG. 46 metering valve.
Figure 49:
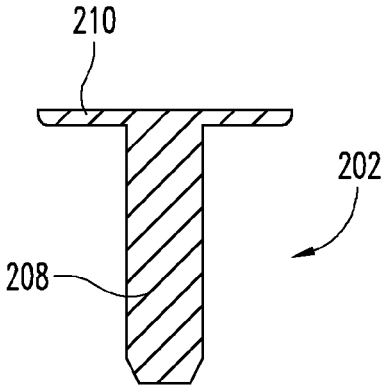
FIG. 49 is a front elevational view, in full section, of the FIG. 46 metering valve, as viewed along cutting plane 49-49 in FIG. 48.
Figure 50:
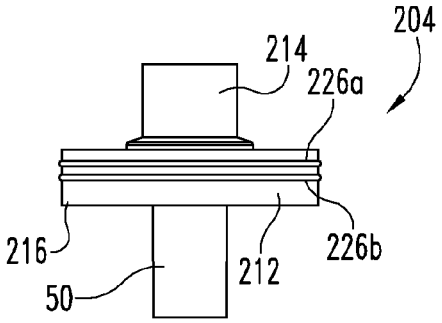
FIG. 50 is a side elevational view of a metering valve holder which comprises one component part of the FIG. 41 foamer.
Figure 51:
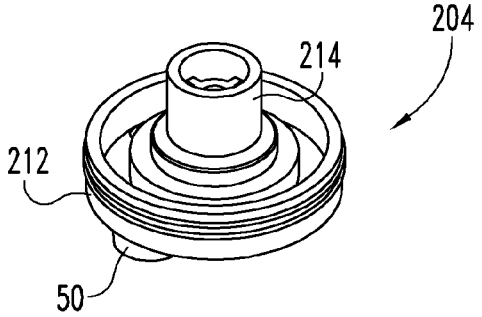
FIG. 51 is a perspective view of the FIG. 50 metering valve holder.
Figure 52:
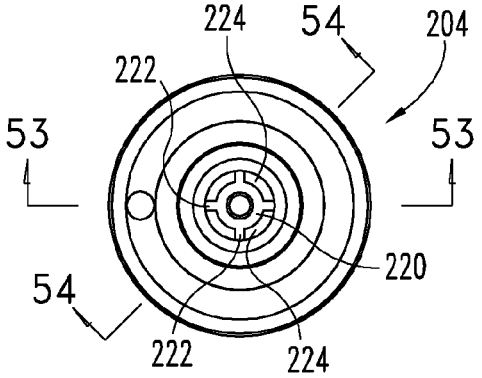
FIG. 52 is a top plan view of the FIG. 50 metering valve holder.
Figure 53:
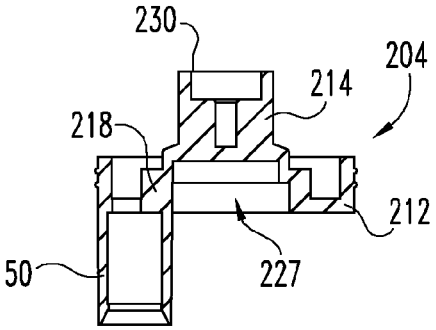
FIG. 53 is a side elevational view, in full section, of the FIG. 50 metering valve holder, as viewed along cutting plane 53-53 in FIG. 52.
Figure 54:
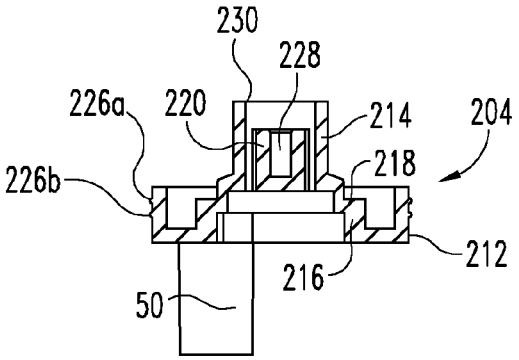
FIG. 54 is an angled side elevational view, in full section, of the FIG. 50 metering valve holder, as viewed along cutting plane 54-54 in FIG. 52.

Referring to FIGS. 41-44, a second foamer embodiment is illustrated. Foamer 200 includes cap 28, closure 34, housing 36, diaphragm 38, mesh insert 40, gasket 42, metering valve 202, metering valve holder 204 and dip tube 48. The duckbill valve 44 and holder 46 have been exchanged for valve 202 and holder 204. All other aspects of foamer 26 are essentially found in foamer 200. Foamer 200 is also fully compatible with container 22 as the closure 34 and dip tube 48 are the same as found in inverted squeeze foamer 20. FIG. 45 illustrates the inverted orientation of inverted squeeze foamer 206 which includes foamer 200, container 22 and liquid product 24.

Metering valve 202, as a separate component part, is illustrated in FIGS. 46-49. Metering valve 202 includes a generally cylindrical post 208 and a generally cylindrical flange 210. The post 208 and flange 210 are generally concentric and are of a molded plastic construction as a single-piece component.

Metering valve holder 204, as a separate component part, is illustrated in FIGS. 50-54. Holder 204 includes a dip tube sleeve 50 which is essentially the same in form, fit and function as the sleeve which is part of holder 46. Otherwise, holders 46 and 204 are of different constructions, representative of their relationship to and cooperation with valves of different construction, specifically valves 44 and 202.

With continued reference to drawing FIGS. 50-54, holder 204 further includes outer annular wall 212, inner annular post 214, base 216 and annular stepped transitional portion 218. Post 214 is constructed and arranged with a center stem 220 which is connected to post 214 by means of four (4) integral spokes 222. The openings 224 between adjacent spokes 222 define flow passages for liquid product. Raised annular ribs 226*a* and 226*b* provide the means for a snap-fit, interference fit or snap-over fit with housing 36. The base 216 defines annular inlet 227.

Stem 220 defines a generally cylindrical bore 228 which is constructed and arranged to receive post 208 with a closely sized interference fit. With post 208 fully inserted into bore 228, flange 210 becomes preloaded into a curved form resting on the upper inside edge 230 of post 214. When there is a flow of liquid product 24 due to the internal pressure which is generated by a squeezing force on the container, some portion or portions of the outer edge of flange 210 are forced off of or out of contact with edge 230. In turn, this creates a flow opening (or openings) for the liquid product which is forced into inlet 227 to pass into the vicinity of mix portion 126 of housing 36.

In terms of the two foamer constructions disclosed herein, referring to foamers 26 and 200, the control and management of the volumetric flows, flow rates, ratios and proportions determine some of the characteristics of the foam which is dispensed. The mesh insert also plays a part, but the liquid-air mix ratio is critical and is independent of the number and style of mesh screens. Another relevant factor is the valve-opening pressure level for the duckbill valve 44 and for the metering valve 202. Comparatively speaking, the duckbill valve 44 opens in response to a lower liquid flow force or pressure than that required to deflect the edges of the metering valve 202. As such, with essentially all other factor or variables being the same, the foam dispensed from squeeze foamer 20 will have a higher moisture content than the foam dispensed from squeeze foamer 206. The foam from the squeeze foamer 206 will be less dense.

During testing and experimentation with the air liquid flows and mix ratios, foamer 26 with the duckbill valve 44 has produced a foam which has a density of 0.078 grams per cubic centimeter. The foam density or "consistency" will be understood from this representative number which also relates to a liquid percentage and relates to the mix ratio which can be calculated on a volumetric basis. This representative foam density will also be understood in relative terms noting that the density of water is approximately 1.0 grams per cubic centimeter. By changing the structural details of duckbill valve 44, changes which could include the material, a density range for the foam being dispensed by foamer 26 is from approximately 0.03 grams per cubic centimeter to approximately 0.25 grams per cubic centimeter. In contrast, foamer 200 with the metering valve 202 is constructed and arranged to dispense a "lighter" foam, due to more air and less liquid. The designed density of the foam being dispensed ranges from approximately 0.012 grams per cubic centimeter to approximately 0.05 grams per cubic centimeter.

In the exemplary embodiments all of the component parts of foamers 26 and 200 with the exception of the dip tube, are unitary, single-piece molded component parts which are fabricated out of a suitable thermoforming or thermosetting plastic. The preferred material for the mesh insert is nylon and the preferred material for the dip tube is polyethylene.

While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by following claims are desired to be protected. All publications, patents, and patent applications cited in this specification are herein incorporated by reference as if each individual publication, patent, or patent application were specifically and individually indicated to be incorporated by reference and set forth in its entirety herein.

The invention claimed is:

1. A squeeze foamer for dispensing a liquid product and air mixture with a foam consistency, said squeeze foamer comprising:

a squeeze container;

a volume of liquid product received by said squeeze container;

a foamer assembled to said squeeze container and including:

a cap;

a closure having a portion received by said cap, said closure and said cap cooperating to define a foam outlet;

a housing assembled into said closure;

an air-flow diaphragm assembled into said housing, said air-flow diaphragm being constructed and arranged to permit the flow of mixing air and separately the flow of make-up air, said air-flow diaphragm including a body with an annular wall which defines an air-flow opening which extends radially through said annular wall;

a mesh screen positioned upstream of said foam outlet;

a liquid valve constructed and arranged for managing the flow of liquid product prior to said liquid product mixing with said mixing air, wherein said liquid valve includes a duckbill valve; and a dip tube for routing air from said squeeze container into said foamer.

2. A foamer for use in dispensing as a foam a mixture of a liquid product and air, said foamer comprising:

a cap;

a closure having a portion received by said cap, said closure and said cap cooperating to define a foam outlet;

a housing assembled into said closure;

an air-flow diaphragm assembled into said housing, said air-flow diaphragm being constructed and arranged to permit the flow of mixing air and the flow of make-up air, said air-flow diaphragm including a body with an annular wall which defines an air-flow opening which extends radially through said annular wall;

a mesh positioned upstream of said foam outlet; and a liquid valve constructed and arranged for managing the flow of liquid product prior to said liquid product mixing with said mixing air.

3. The foamer of claim 2 wherein said liquid valve includes a duckbill valve.

4. The foamer of claim 2 which further includes a liquid valve holder.

5. The foamer of claim 4 wherein said liquid valve holder is received by said housing.

6. The foamer of claim 4 wherein one portion of said diaphragm is cooperatively arranged with said liquid valve holder for managing air flow.

7. The foamer of claim 2 wherein a portion of said diaphragm is cooperatively arranged with said housing for managing air flow.

8. The foamer of claim 2 wherein one portion of said diaphragm is cooperatively arranged with said liquid valve holder for managing the flow of mixing air.

9. The foamer of claim 2 wherein one portion of said diaphragm is cooperatively arranged with said housing for managing the flow of make-up air.

10. The foamer of claim 2 wherein said housing defines a mix portion for air and product to mix before receipt by said mesh.

11. The foamer of claim 2 wherein said liquid valve is constructed and arranged as a metering valve and is received by a cooperating holder.

12. The foamer of claim 11 wherein said metering valve includes a deflectable flange which is movable in response to product flow.

13. The foamer of claim 2 wherein said diaphragm body is annular and defines an edge at one end of said annular wall and wherein said air-flow passage through said annular wall segments said edge.

14. A squeeze foamer for dispensing a liquid product and air mixture with a foam consistency, said squeeze foamer comprising:

a squeeze container;

a volume of liquid product received by said squeeze container;

a foamer assembled to said squeeze container and including:

a cap;

a closure having a portion received by said cap, said closure and said cap cooperating to define a foam outlet;

a housing assembled into said closure;

an air-flow diaphragm assembled into said housing, said air-flow diaphragm being constructed and arranged to permit the flow of mixing air and the flow of make-up air, said air-flow diaphragm including a body with a movable inner lip on an inner surface of said body for the control of mixing air and a movable outer lip on an outer surface of said body for the control of make-up air, said body including an annular wall which defines an air-flow opening which extends radially through said annular wall;

a mesh positioned upstream of said foam outlet; and a liquid valve constructed and arranged for managing the flow of liquid product prior to said liquid product mixing with said mixing air; and a dip tube for routing air from said squeeze container into said foamer.

15. The squeeze foamer of claim 14 wherein said liquid valve includes a duckbill valve.

16. The squeeze foamer of claim 14 which further includes a liquid valve holder.

17. The squeeze foamer of claim 16 wherein one portion of said diaphragm is cooperatively arranged with said liquid valve holder for managing air flow.

18. The squeeze foamer of claim 14 wherein a portion of said diaphragm is cooperatively arranged with said housing for managing air flow.

19. The squeeze foamer of claim 14 wherein said squeeze foamer is constructed and arranged as an inverted squeeze foamer when dispensing said product.

20. The squeeze foamer claim 14 wherein said air-flow opening providing an air-flow path from said dip tube to said inner lip.

21. A foamer for use in dispensing as a foam a mixture of a liquid product and air, said foamer comprising:

a cap;

a closure having a portion received by said cap, said closure and said cap cooperating to define a foam outlet;

a housing assembled into said closure;

an air-flow diaphragm assembled into said housing, said air-flow diaphragm being constructed and arranged to permit the flow of mixing air and the flow of make-up air, said air-flow diaphragm including a body with an annular wall which defines an air-flow passage radially through said annular wall;

a mesh positioned upstream of said foam outlet; and a liquid valve constructed and arranged for managing the flow of liquid product prior to said liquid product mixing with said mixing air, wherein said liquid valve is constructed and arranged as a metering valve and is received by a cooperating holder.

22. The foamer of claim 21 wherein said metering valve includes a deflectable flange which is movable in response to product flow.

23. A foamer for use in dispensing as a foam a mixture of a liquid product and air, said foamer comprising:

a cap;

a closure having a portion received by said cap, said closure and said cap cooperating to define a foam outlet;

a housing assembled into said closure;

an air-flow diaphragm assembled into said housing, said air-flow diaphragm being constructed and arranged to permit the flow of mixing air and the flow of make-up air, said air-flow diaphragm including a body with an annular wall which defines an air-flow passage radially through said annular wall;

a mesh positioned upstream of said foam outlet; and a liquid valve constructed and arranged for managing the flow of liquid product prior to said liquid product mixing with said mixing air, wherein said diaphragm body is annular and defines an edge at one end of said annular wall and wherein said air-flow passage through said annular wall segments said edge.

* * * * *